US007926653B2

(12) United States Patent
Tawada et al.

(10) Patent No.: US 7,926,653 B2
(45) Date of Patent: Apr. 19, 2011

(54) CIGARETTE BOX AND BLANK SET FOR SAME

(75) Inventors: Shunsuke Tawada, Tokyo (JP); Tetsuya Nakamura, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 113 days.

(21) Appl. No.: 12/073,525

(22) Filed: Mar. 6, 2008

(65) Prior Publication Data

US 2008/0164160 A1 Jul. 10, 2008

Related U.S. Application Data

(63) Continuation of application No. PCT/JP2006/316741, filed on Aug. 25, 2006.

(30) Foreign Application Priority Data

Sep. 8, 2005 (JP) ..... 2005-260664

(51) Int. Cl.
*B65D 15/00* (2006.01)

(52) U.S. Cl. ..... 206/267; 220/345.2; 220/345.4

(58) Field of Classification Search ..... 206/267, 206/264, 271, 273; 229/125.12, 125.125, 229/220; 220/345.1, 345.2, 345.4
See application file for complete search history.

(56) References Cited

U.S. PATENT DOCUMENTS

| | | | | |
|---|---|---|---|---|
| 1,965,049 | A | 7/1934 | Nahm | |
| 2,202,281 | A * | 5/1940 | Wilson | 206/264 |
| 2,315,900 | A * | 4/1943 | Lupfer | 206/259 |
| 2,489,452 | A | 11/1949 | Davis | |
| 2,846,130 | A * | 8/1958 | Foote | 229/125.12 |
| 2,902,201 | A | 9/1959 | Engblom | |
| 2,931,554 | A | 4/1960 | Matern | |
| 3,052,398 | A * | 9/1962 | Benjamin | 229/125.37 |
| 3,190,534 | A | 6/1965 | Tamarin | |
| 3,302,844 | A * | 2/1967 | Henry | 229/120.18 |
| 4,534,463 | A * | 8/1985 | Bouchard | 206/267 |
| 5,080,227 | A * | 1/1992 | Focke | 206/273 |
| 5,711,423 | A * | 1/1998 | Fuller, Jr. | 206/246 |
| 7,377,385 | B2 * | 5/2008 | Giannini et al. | 206/267 |

FOREIGN PATENT DOCUMENTS

| | | | |
|---|---|---|---|
| CN | 2504908 | Y | 8/2002 |
| CN | 2511620 | Y | 9/2002 |
| EP | 0950618 | A2 | 10/1999 |
| JP | 5-213340 | A | 8/1993 |
| RU | 2242415 | A | 12/2004 |
| WO | WO-99/38776 | A1 | 8/1999 |

* cited by examiner

*Primary Examiner* — David T Fidei
(74) *Attorney, Agent, or Firm* — Birch, Stewart, Kolasch & Birch, LLP

(57) ABSTRACT

A cigarette box has a box body (2) enclosing a filter-cigarette inner pack and having an access opening (4) at the top thereof, and a slide lid (6) attached to cover an upper portion of the box body (2), where the slide lid (6) is allowed to reciprocate along the breadth of the box body (2) to open and close the access opening (4).

10 Claims, 11 Drawing Sheets

CIGARETTE BOX AND BLANK SET FOR SAME

This application is a Continuation of copending PCT International Application No. PCT/JP/2006/316741 filed on Aug. 25, 2006, which designated the United States, and on which priority is claimed under 35 U.S.C. §120. This application also claims priority under 35 U.S.C. §119 (a) on patent application Ser. No(s). 2005-260664 filed in Japan on Sep. 8, 2005. The entire contents of each of the above documents is hereby incorporated by reference.

TECHNICAL FIELD

This invention relates to a cigarette box and a blank set for it, where the cigarette box is used to contain an inner pack and the inner pack comprises a bundle of filter cigarettes or cigarettes and a wrapper wrapping the bundle.

BACKGROUND ART

For such cigarette boxes, so-called hinged lid packages are frequently used. As disclosed in Japanese Unexamined Patent Publication No. Hei 5-213340, for example, the package of this type has a box body and a lid for opening and closing the box body, and the inner pack is contained in the box body.

Common people including smokers have been long familiar with the above-described shape of the package. Thus, there is no freshness in the package opening and closing operation, and the package is poor in such visual attraction that increases the user's buying motivation.

The primary object of the present invention is to provide a cigarette box having such novel opening and closing mode that can increase the user's buying motivation, and a blank set for it.

DISCLOSURE OF THE INVENTION

In order to achieve the above object, the cigarette box according to the present invention is designed to contain an inner pack including a bundle of cigarettes and a wrapper wrapping the bundle. The cigarette box according to the present invention comprises a box body enclosing the inner pack and having an access opening for the cigarette at the top thereof, the access opening facing upward, and a slide lid attached to cover an upper portion of the box body, the slide lid being allowed to reciprocate along the breadth of the box body to open and close the access opening.

In the case of this cigarette box, when the user pulls out the slide lid from the box body, along the breadth of the box body, the access opening of the box body become exposed. Thus, the user can remove a filter cigarette or cigarette from the box body, through the access opening. Then the user can close the access opening of the box body by pushing back the slide lid, along the breadth of the box body.

The cigarette box according to the present invention provides an opening and closing mode greatly different from the common hinged lid package and a novel appearance, thereby increasing the user's buying motivation.

Specifically, the box body can be designed to include an inner case providing the access opening, and an outer case enclosing the inner case except for an upper portion of the inner case, where the slide lid has a side opening at one side, the side opening allowing the slide lid to reciprocate.

In this case, the outer case can be designed to include a side wall disposed on the same side as the side opening and an extension extending upward from the side wall, the extension covering a side wall of said upper portion of the inner case, from the outside. When the slide lid is in a closed position, the extension conceals the side opening of the slide lid, thereby ensuring a fine appearance of the cigarette box.

Desirably, the cigarette box should further comprise a stopper for preventing the slide lid from coming off the box body. Specifically, the stopper can be designed to include a strip extending from the slide lid, through between the inner case and the outer case, and allowed to reciprocate with the slide lid, so that when the slide lid is opened, the strip collides with the inner surface of the outer case, thereby determining an open position for the slide lid.

Alternatively, the stopper can be designed to include a U-shaped strap extending from the slide lid, having a U-shape surrounding the inner case, and allowed to reciprocate with the slide lid, so that when the slide-lid is opened, the strap collides with the inner surface of the outer case, thereby determining an open position for the slide lid, and that when the slide lid is pulled upward, the strap collides with the bottom of the inner case, thereby preventing the slide lid from coming off the box body.

The present invention also provides a blank set for forming the cigarette box provided with the above-mentioned strap, the blank set comprising an inner blank for forming the inner case, an outer blank for forming the outer case, and a lid blank for forming the slide lid. The details of the blanks will become clear from the attached drawings and description below.

BEST MODE OF CARRYING OUT THE INVENTION

Figure 1:
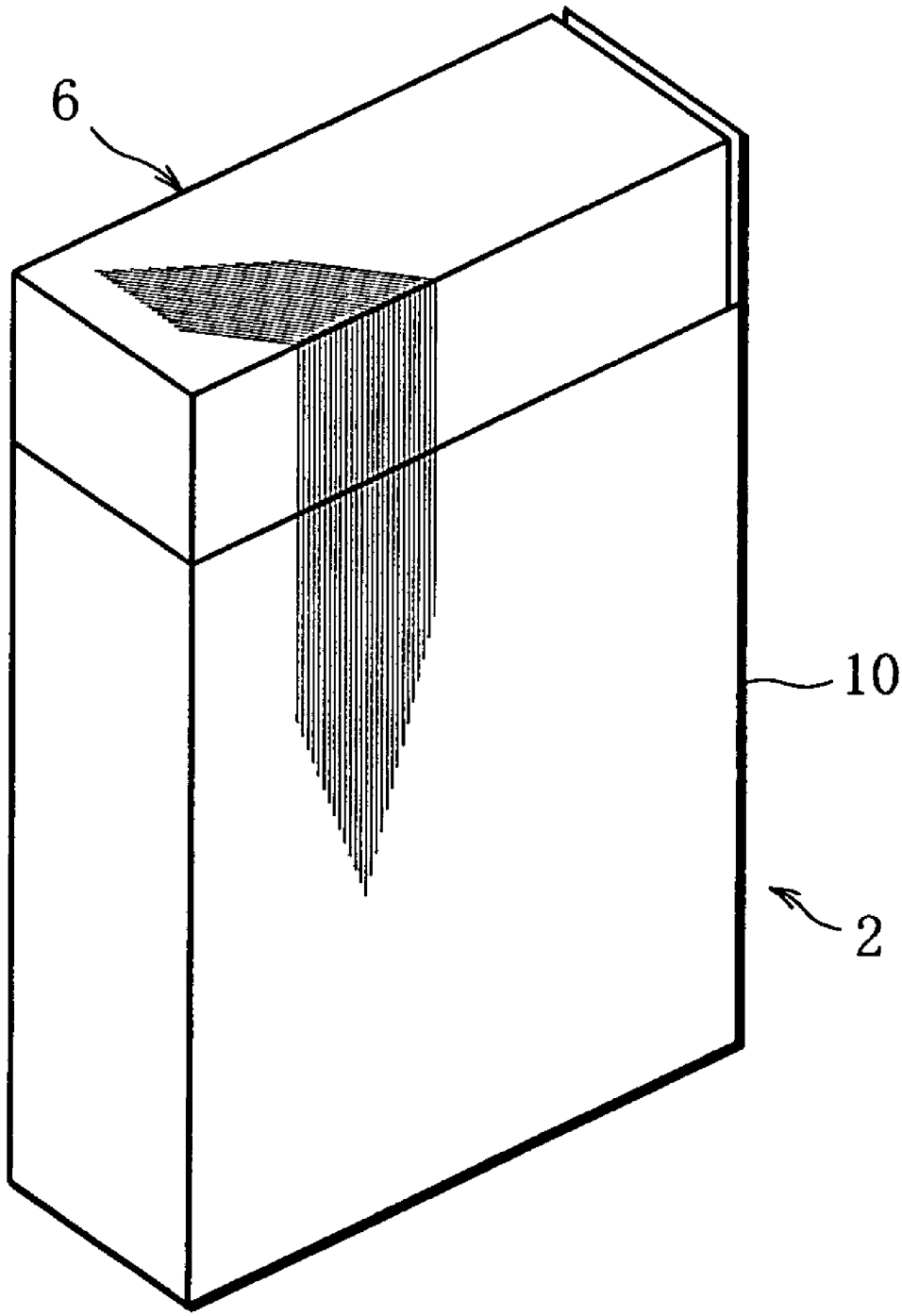
[FIG. 1] A perspective view showing an embodiment of a cigarette box in a closed state.
Figure 2:
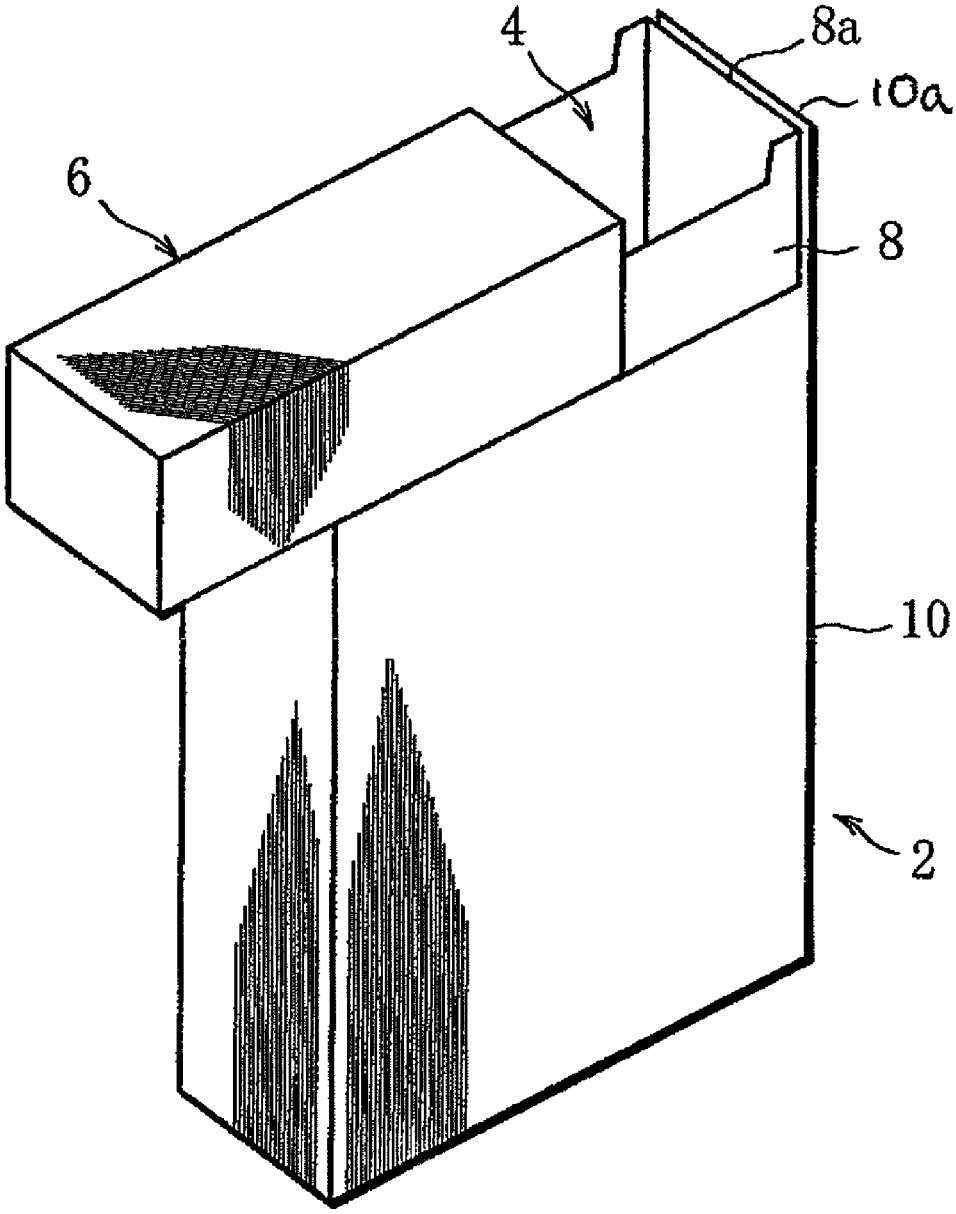
[FIG. 2] A perspective view showing the cigarette box of FIG. 1 in an open state.

FIGS. 1 and 2 show an embodiment of a cigarette box.

The cigarette box includes a parallelepiped box body 2. The box body 2 has an access opening 4 at the top. The box body 2 contains an inner pack (omitted in FIG. 1), and the inner pack includes a bundle of filter cigarettes or cigarettes and a wrapper wrapping the bundle.

A slide lid 6 is fitted on top of the box body 2. The slide lid 6 is allowed to reciprocate along the breadth of the box body 2, thereby opening and closing the access opening 4 of the box body 2.

More specifically, as clear from FIG. 2, the box body 2 includes an inner case 8 providing the access opening 4 and an outer case 10 enclosing the inner case 8. The outer case 10 has a top opening facing upward. The inner case 8 has an upper portion projecting upward from the top opening of the outer case 10, and a side wall 8*a* of this upper portion is covered with an extension 10*a* of a side wall of the outer case 10. The extension 10*a* extends upward from a side edge of the top opening of the outer case 10.

Also the inner case 8 has a top opening facing upward, and this top opening forms the access opening 4.

Like the box body 2, the slide lid 6 is parallelepiped in shape and has a bottom opening facing downward. The slide lid 6 is attached to cover the upper end portion of the inner case 8 not covered with the outer case 10. The slide lid 6 has also a side opening facing sideways of the box body 2. The side opening is located on the side wall 8*a* side of the inner case 8. This side opening allows the slide lid 6 to reciprocate along the breadth of the box body 2. More specifically, the bottom opening of the slide lid 6 has front and rear edges which are seated and slide on the front and rear edges of the top opening of the outer case 10.

When the slide lid 6 is opened as shown in FIG. 2, the slide lid 6 projects sideways from the box body 2. Thus, the present embodiment of the cigarette box is unique in opening and closing mode and appearance compared with common hinged-lid packages and therefore increases the user's buying motivation.

The above-described structure of the cigarette box will become clearer from the explanation of a blank set for forming the cigarette box.

In the explanation of the blank set, FIGS. 1 and 2 are regarded as perspective views of the cigarette box viewed from the front.

Figure 3:
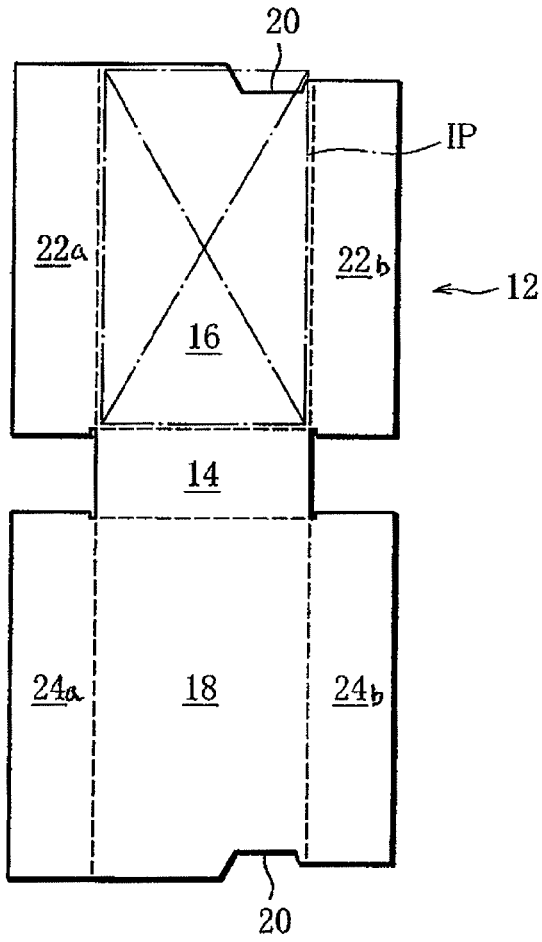
[FIG. 3] A diagram showing a blank for forming an inner case of FIG. 2.

The blank set comprises three blanks. FIG. 3 shows a blank 12 for forming the inner case 8, more specifically the inner side of the blank 12.

The blank 12 includes a plurality of panels and a plurality of flaps, where the adjacent panels as well as the adjacent panel and flap are demarcated by fold lines shown in broken lines.

The blank 12 includes a rear panel 16, a bottom panel 14 and a front panel 18, and these panels are arranged along the longitudinal axis of the blank 12, adjacent to each other, with the bottom panel 14 in the center. When viewed in FIG. 3, approximately U-shape notches 20 are formed at the upper edge of the rear panel 16 and the lower edge of the front panel 18, respectively. The notches 20 are adjacent to the right side edges of the corresponding panels.

Inner side flaps 22*a*, 22*b* are joined to the rear panel 16 on the opposite sides, and outer side flaps 24*a*, 24*b* are joined to the front panel 18 on the opposite sides. As clear from FIG. 3, the inner side flap 22*b* and the outer side flap 24*b* adjacent to the notches 20 are slightly smaller in length than the inner side flap 22*a* and the outer side flap 24*a* remote from the notches. Here, the length of the side flaps 22, 24 means the height from the bottom panel 14.

Figure 4:
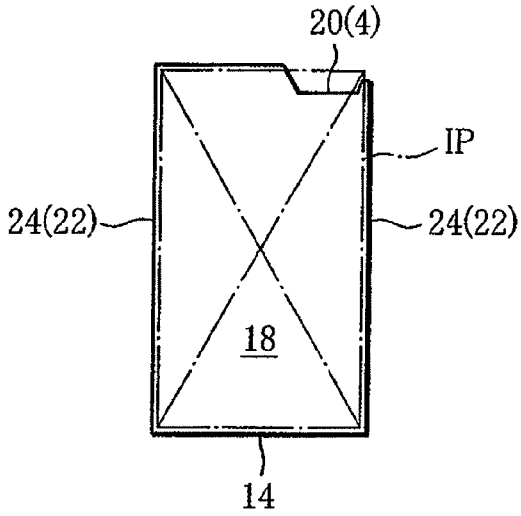
[FIG. 4] A diagram showing the inner case formed from the blank of FIG. 3.

Prior to folding the blank 12, glue is applied to the inner side of the blank 12, at specified locations. Then, an inner pack IP is placed on the inner side of the blank 16, and the blank 12 is folded over the inner pack IP. Specifically, the panels and side flaps of the blank 12 are folded over the inner pack IP successively, so that an inner case 8 as shown in FIG. 4 is formed to enclose the inner pack IP. It is to be noted that the inner pack IP includes a bundle of filter cigarettes or cigarettes and a wrapper wrapping the bundle.

The bottom panel 14, rear panel 16 and front panel 18 of the blank 12 form a bottom, a rear wall and a front wall of the inner case 8, respectively. On each side, the inner side flap 22 and the outer side flap 24 are laid one on the other and glued together to form a side wall of the inner case 8.

The inner case 8 has a top opening at the top, so that the top face of the inner pack IP is exposed in the top opening of the inner case 8. The notches 20 of the rear and front panels 16, 18 face each other and define the above-mentioned access opening 4 at the front and rear walls, respectively.

Figure 5:
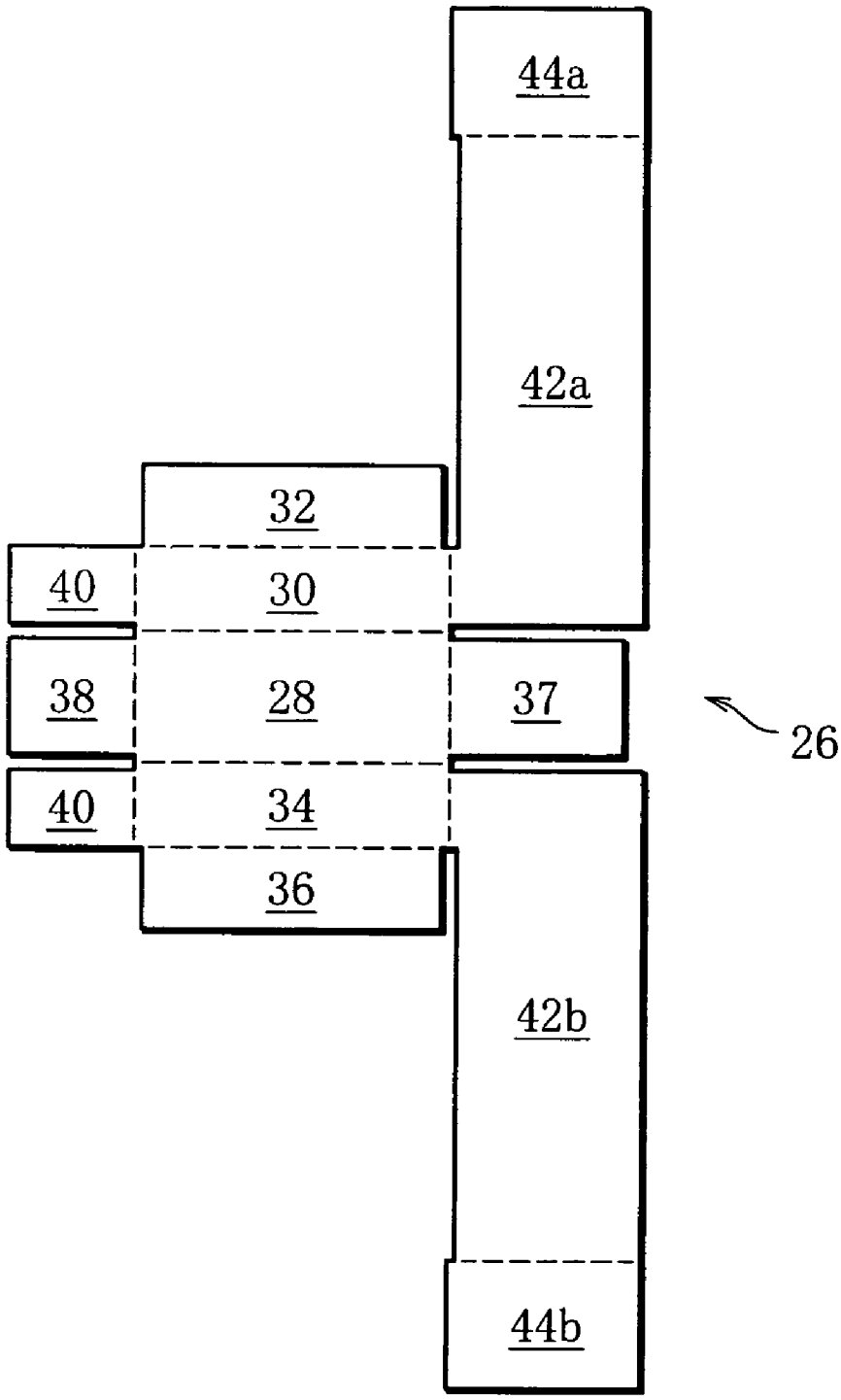
[FIG. 5] A diagram showing a blank for forming a slide lid of FIG. 2.

FIG. 5 shows a blank 26 for forming the slide lid 6, more specifically, the inner side of the blank 26.

Also the blank 26 includes a plurality of panels and a plurality of flaps, where the adjacent panels as well as the adjacent panel and flap are demarcated by fold lines shown in broken lines.

The blank 26 has a top panel 28 in the center. When viewed in FIG. 5, to the upper edge of the top panel 28, an outer front panel 30 an inner front flap 32 are joined in turn, and to the lower edge of the top panel 28, an outer rear panel 34 and an inner flap 36 are joined in turn.

Further, a liner flap 37 is joined to the right side edge of the top panel 28, and an outer side flap 38 is joined to the left side edge of the top panel 28. To the left side edges of the outer front panel 30 and the outer rear panel 34, inner side flaps 40 are joined, respectively.

To the right side edges of the outer front panel 30 and the outer rear panel 34, extension panels 42*a*, 42*b* are joined, respectively. The extension panels 42*a*, 42*b* extend oppositely to each other, along the direction of the arrangement of the panels 28 to 36, and have bottom flaps 44*a*, 44*b* at the respective distal ends.

Prior to folding the blank 26, glue is applied to the inner side of the blank 26, at specified locations. Then, the blank 26 is folded in the order shown in FIGS. 6 to 9 to form the slide lid 6.

Figure 6:
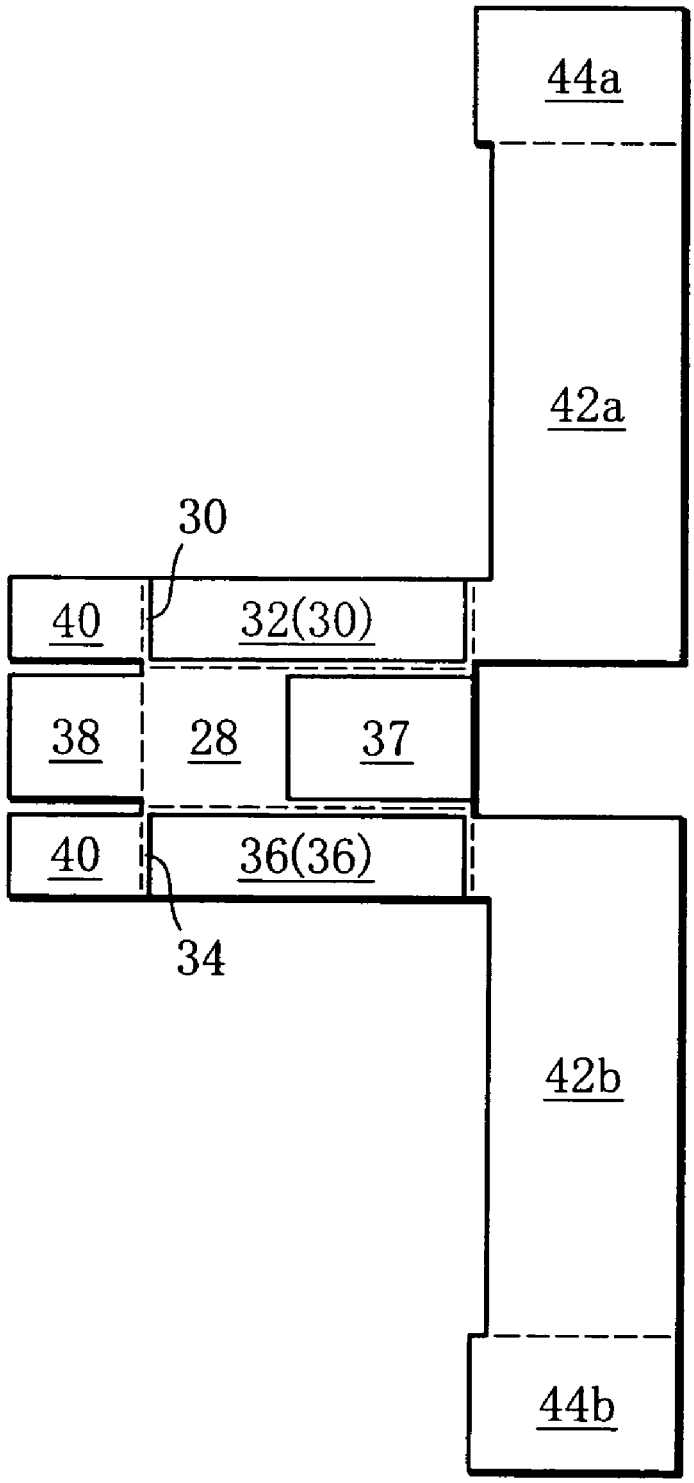
[FIG. 6] A diagram showing the state after a first folding operation is performed on the blank of FIG. 5.

As shown in FIG. 6, first, the liner flap 37 is folded toward the top panel 28 to be overlaid on the top panel 28. The flap 37 and the panel 28 are glued together. At the same time as the liner flap 37 is folded, the inner front flap 32 is folded toward the outer front panel 30 to be overlaid on the panel 30. The panel 30 and the flap 32 are glued together to form a front wall of the slide lid 6. In the same manner, the inner front flap 36 is folded toward the outer rear panel 34 to be overlaid on the panel 34. The panel 34 and the flap 36 are glued together to form a rear wall of the slide lid 6.

Figure 7:
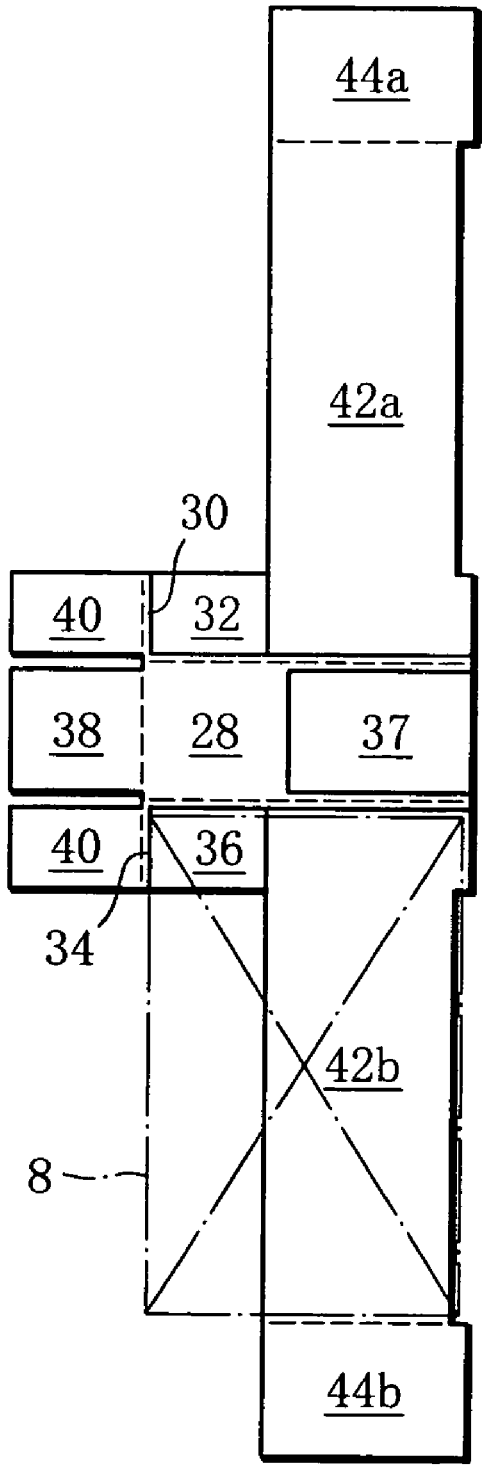
[FIG. 7] A diagram showing the state after a further folding operation is performed on the blank in the state of FIG. 6.

Then, as shown in FIG. 7, the extension panels 42*a*, 42*b* are folded toward the inner front flap 32 and the inner rear flap 36 to overlap the flaps 32, 36, respectively.

In this state, the above-mentioned inner case 8 is placed to overlap the extension panel 42*b* and the inner rear flap 36, where the notches 20 of the inner case 8 are located on the liner flap 37 side.

Figure 8:
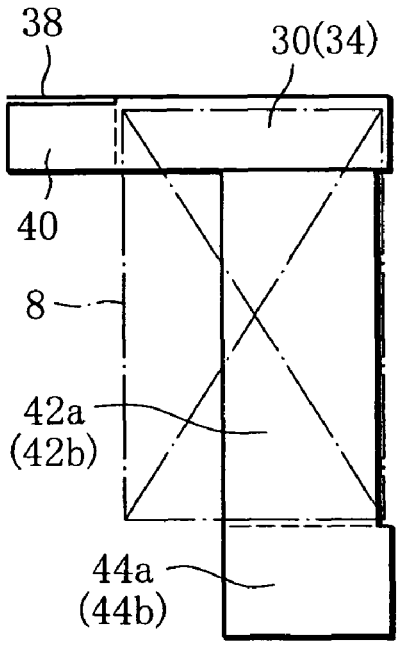
[FIG. 8] A diagram showing the state after a further folding operation is performed on the blank in the state of FIG. 7.

Then, the top panel 28 with the liner flap 37 is folded toward the top opening of the inner case 8 to cover the top opening. Then, with the extension panel 42*a*, the outer front panel 30 and inner front flap 32 glued together are folded toward the front face of the inner case 8 to be overlaid on the front face. As shown in FIG. 8, this folding operation causes the outer side flap 38 and the inner side flaps 40 in a pair to project sideways from the inner case 8. At this time, the extension panels 42*a*, 42*b* hold the inner case 8 between them, and the bottom flaps 44*a*, 44*b* connected with the panels 42*a*, 42*b* project from the bottom of the inner case 8 and face each other.

Figure 9:
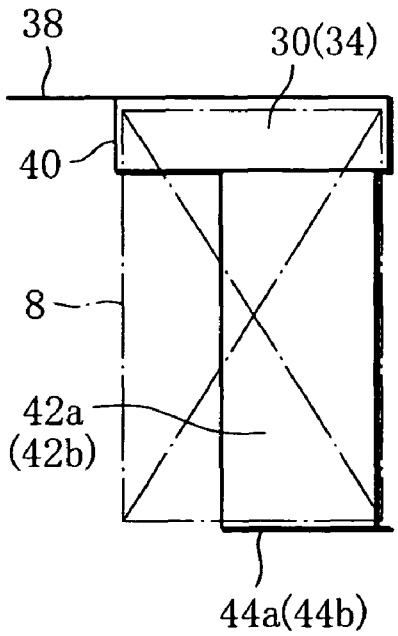
[FIG. 9] A diagram showing the state after a further folding operation is performed on the blank in the state of FIG. 8.

Then, as shown in FIG. 9, the two inner side flaps 40 are folded toward the side face of the inner case 8 successively, to lie one on the other on this side face. At the same time as the inner side flaps 40 are folded, the two bottom flaps 44*a*, 44*b* are folded toward the bottom face of the inner case 8 successively, to lie one on the other on the bottom face. The bottom flaps 44*a*, 44*b* are glued together, so that the bottom flaps 44 laid one on the other and the extension panels 42 in a pair form a U-shaped strap surrounding the inner case 8. It is to be noted that when viewed in FIG. 9, the bottom flaps 44 are located on the right side of the bottom face of the inner case 8 to cover only part of the bottom face.

Last, the outer side flap 38 is folded toward the two inner side flaps 40 already folded down to be overlaid on the inner side flaps 40. The outer side flap 38 is glued to the outer one of the inner side flaps 40 to form a side wall of the slide lid 6. At this time, as shown in FIGS. 10 and 11, the slide lid 6 attached to the inner case 8, or in other words, the lidded inner case 8' is completed.

Figure 10:
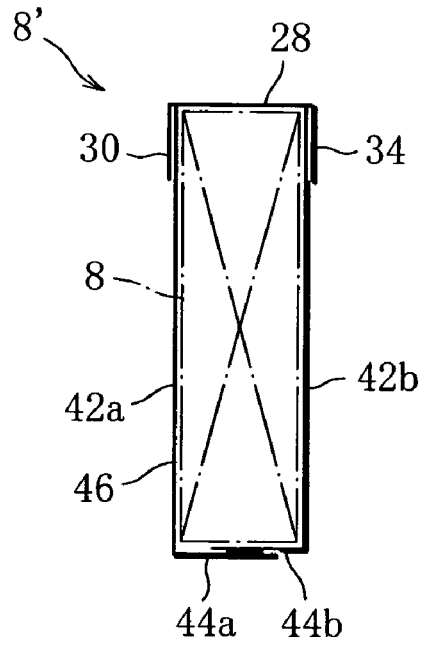
[FIG. 10] A side view showing one side of the inner case with the slide lid attached.
Figure 11:
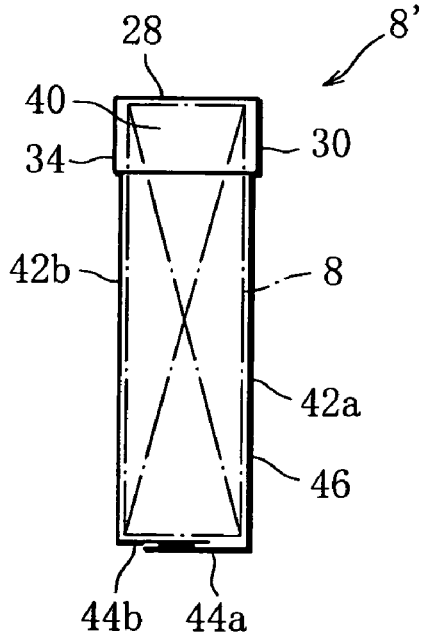
[FIG. 11] A side view showing the opposite side of the inner case of FIG. 10.

As clear from FIGS. 10 and 11, the slide lid 6 has a side opening at one side thereof. The above-mentioned strap 46 is not glued to the inner case 8 so that, relative to the inner case 8, the strap can reciprocate with the slid lid 6, along the breadth of the inner case 8.

Figure 12:
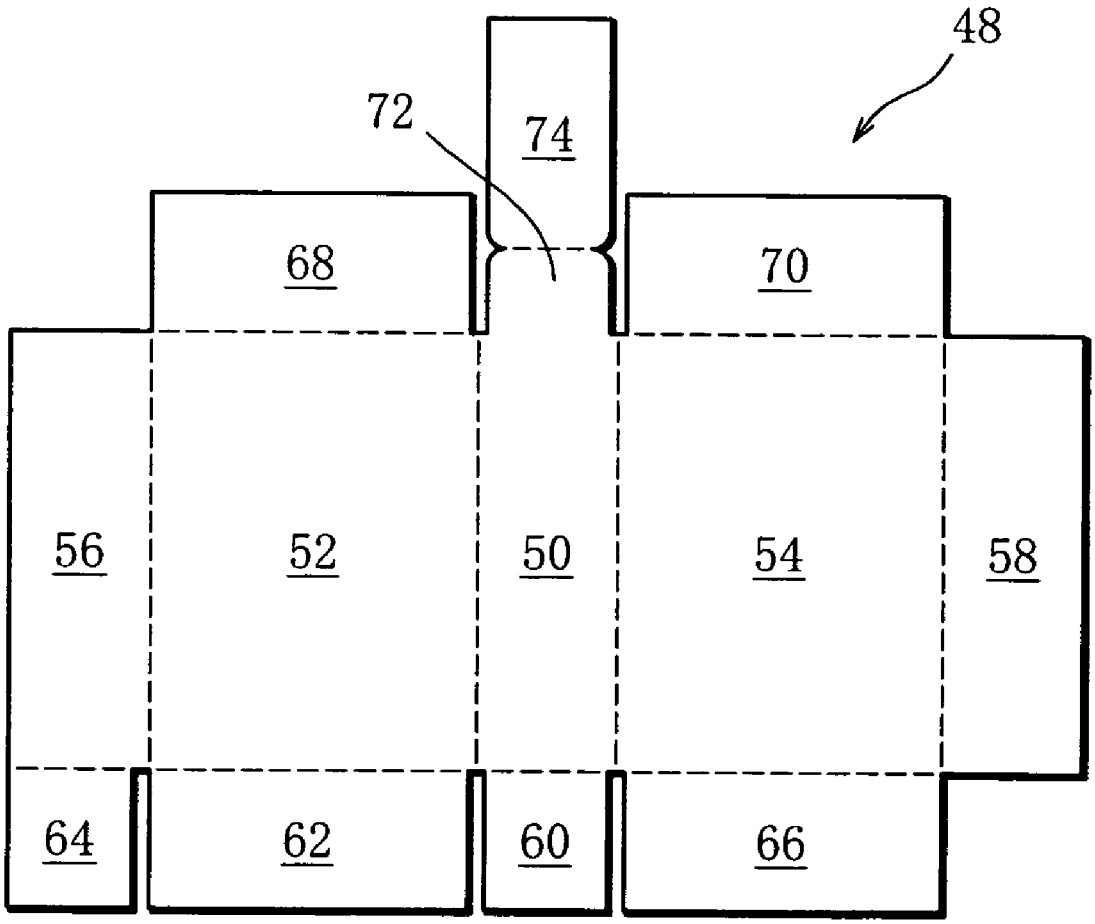
[FIG. 12] A diagram showing a blank for forming an outer case of FIG. 2.

FIG. 12 shows a blank 48 for forming the outer case 10, more specifically, the inner side of the blank 48.

The blank 48 includes a plurality of panels and a plurality of flaps, where the adjacent panels as well as the adjacent panel and flap are demarcated by fold lines shown in broken lines.

The blank 48 has a side panel 50 in the center. When viewed in FIG. 12, a rear panel 52 and a front panel 54 are joined to the opposite side edges of the side panel 50. An inner side panel 56 is joined to the side edge of the rear panel 52 remote from the side panel 50, and an outer side flap 58 is joined to the side edge of the front panel 54 remote from the side panel 50. These panels and flaps are arranged along the longitudinal axis of the blank 48.

To the lower edges of the side panel 50, the rear panel 52, the inner side flap 56 and the front panel 54, inner bottom flaps 60, 62, 64, 66 are joined, respectively. To the upper edges of the rear panel 52 and the front panel 54, liner flaps 68, 70 are joined, respectively.

The side panel 50 has an extension 72 at the top. The extension 72 projects from the level of the upper edges of the rear panel 52 and the front panel 54. To the distal end of the extension 72, a liner flap 74 is joined. The length for which the extension 72 projects is almost equal to the height of the slide lid 6.

Prior to folding the blank 48, glue is applied to the inner side of the blank 48, at specified locations. Then, the blank 48 is folded in the order shown in FIGS. 13 to 16 to complete the cigarette box shown in FIGS. 1 and 2.

Figure 13:
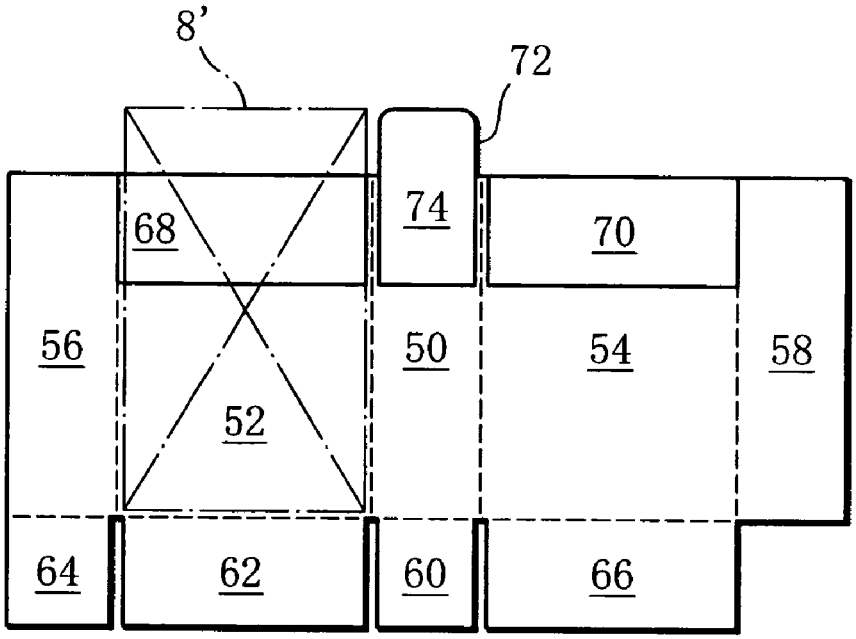
[FIG. 13] A diagram showing the state after a first folding operation is performed on the blank of FIG. 12.

First, as shown in FIG. 13, the liner flaps 68, 70 are folded toward the rear panel 52 and the front panel 54 to be overlaid on the panels 52, 54, respectively. The liner flaps 68, 70 are glued to the rear panel 52 and the front panel 54, respectively. At the same time as the liner flaps 68, 70 are folded, the liner flap 74 is folded toward the side panel 50 so that the liner flap 74 is overlaid on the side panel 50 and the extension 72 of the side panel 50.

Then, the above-mentioned lidded inner case 8' is placed on the rear panel 52, where the flap 68 already folded down is located between the inner case 8' and the rear panel 52. In this state, the slide lid 6 of the inner case 8' projects from the rear panel 52, and the side opening of the slide lid 6 is adjacent to the extension 72 of the side panel 50.

Figure 14:
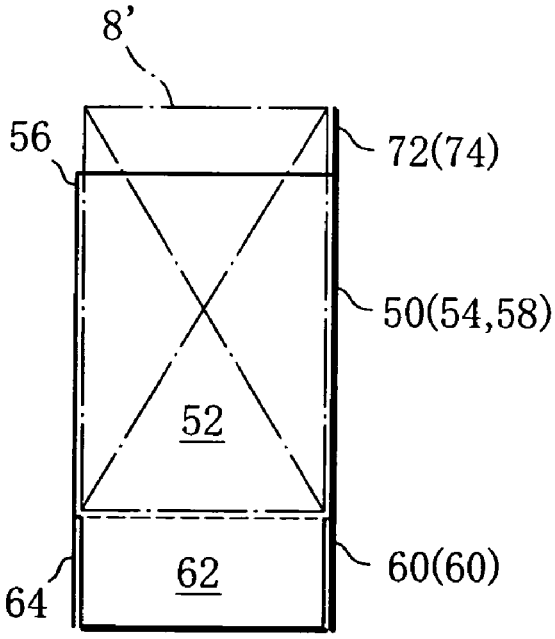
[FIG. 14] A diagram showing the state after a further folding operation is performed on the blank in the state of FIG. 13.

Next, as shown in FIG. 14, the inner side flap 56 and the side panel 50 are folded toward the corresponding side faces of the inner case 8' to be overlaid on them, respectively. As a result of this folding operation, the side panel 50 forms one side wall of the outer case 10. This side wall has an upper end portion which is overlaid on the side wall 8*a* of the inner case 8. This upper end portion is made up of the extension 72 of the side panel 50 and the liner flap 74.

Figure 15:
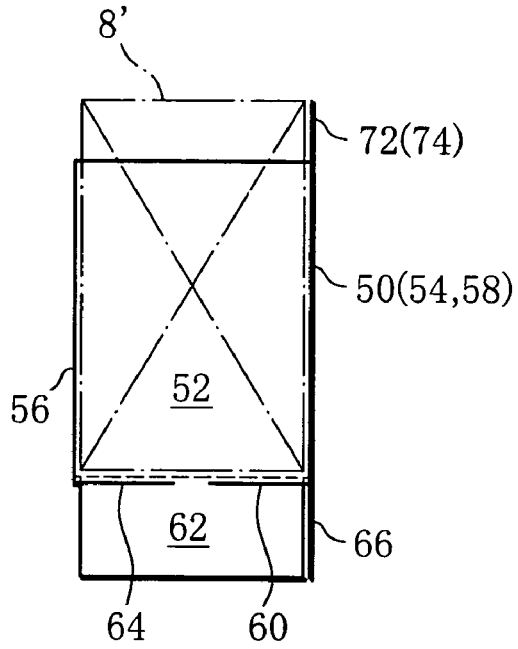
[FIG. 15] A diagram showing the state after a further folding operation is performed on the blank in the state of FIG. 14.
Figure 16:
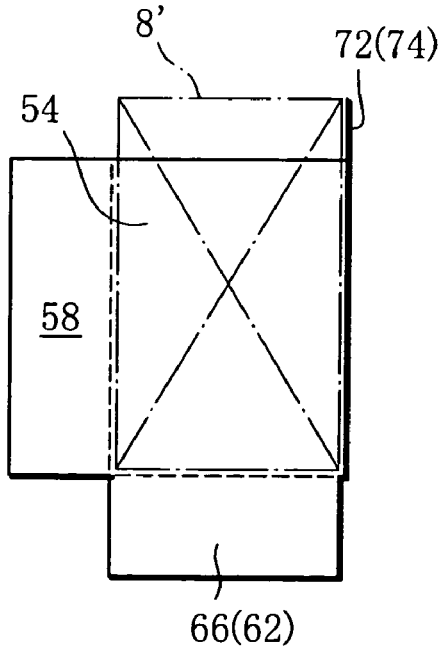
[FIG. 16] A diagram showing the state after a further folding operation is performed on the blank in the state of FIG. 15.

As shown in FIG. 15, the inner bottom flaps 60, 64 are folded toward the bottom face of the inner case 8' to be overlaid on the bottom face. Next, as shown in FIG. 16, the front panel 54 is folded toward the front face of the inner case 8' to be overlaid on the front face. This folding operation causes the outer side flap 58 and outer bottom panel 66 connected with the front panel 54 to project from the side face and bottom face of the inner case 8'.

Next, the inner bottom flap 62 connected with the rear panel 52 is folded toward the inner bottom flaps 60, 64 already folded down, to be overlaid on the flaps 60, 64. Then, the outer side flap 58 is folded toward the inner side flap 56 already folded down to be overlaid on the inner side flap 56. The inner and outer side flaps 56, 58 are glued together to form the other side wall of the outer case 10. At the same time as the outer side flap 58 is folded, the outer bottom panel 66 is folded toward the inner bottom flap 62 already folded down to be overlaid on the inner bottom flap 62. The inner and outer bottom flaps 62, 66 are glued together to form a bottom of the outer case 10. At this time, the cigarette box shown in FIG. 1 is completed.

The slide lid 6, which is not glued to the inner case 8 nor the outer case 10, is allowed to reciprocate along the breadth of the box body 2. Thus, by reciprocally sliding the slide lid 6 on the box body 2, the user can open and close the access opening 4 of the inner case 8.

When the slide lid 6 is opened, the above-mentioned U-shaped strap 46 (see FIGS. 10 and 11) collides with the inner surface of the other side wall of the outer case 10, so that further sliding of the slide lid 6 is hindered. Thus, the slide lid 6 is prevented from coming off the inner case 8 sideways.

If the slide lid 6 is pulled upward, the strap 46 (bottom flaps 44) collides with the bottom of the inner case 8, so that the slide lid 6 is prevented from coming off the inner case 8 upwardly.

The bottom portion of the strap 46 (bottom flaps 44) has a size that allows the strap to always overlap the inner bottom flap 60 and inner bottom flap 64 of the outer case 10, regardless of the slide lid 6 sliding, i.e., opening and closing operation. Thus, the strap 46 does not catch on the edge of the flap 60 or 64, and therefore does not obstruct the slide lid 6 opening and closing operation. Further, since the bottom of the inner case 8 is made up of the bottom panel 14, the strap 46 does not catch on the bottom of the inner case 8, either.

The side wall 10*a* of the outer case 10 has an extension 72, and when the slide lid 6 is in the closed position, the extension 72 covers the side opening of the slide lid 6, which ensures a fine appearance of the cigarette box.

The present invention is not limited to the above-described embodiment of the cigarette box and blank but allows various modifications to the described cigarette box and blank. For example, the cigarette box according to the invention can include, in place of the strap 46, a stopper for the slide lid 6 which can vary in type.

The invention claimed is:

1. A cigarette box for containing an inner pack, the inner pack including a bundle of cigarettes and a wrapper wrapping the bundle, comprising:

a box body enclosing the inner pack and having an access opening for the cigarettes at the top thereof, the access opening facing upward, and a slide lid attached to cover an upper portion of said box body, said slide lid including a front wall, a rear wall and a side wall which surround the upper portion of said box body, and a side opening so that said slide lid is allowed to reciprocate along a breadth of said box body to open and close the access opening;

wherein said box body includes:

an inner case providing the access opening, and an outer case enclosing the inner case except for an upper portion of the inner case, said slide lid covers the upper portion of the inner case, and said outer case has a top opening through which the upper portion of the inner case projects, and said lid is seated on front and rear edges of said top opening to be slid on the front and rear edges.

2. The cigarette box according to claim 1, wherein the outer case includes a side wall disposed on a same side as the side opening and an extension extending upward from the side wall of the outer case, the extension covering a side wall of said upper portion of the inner case, from the outside.

3. The cigarette box according to claim 1, further comprising a stopper for preventing the slide lid from coming off said box body.

4. The cigarette box according to claim 3, wherein said stopper includes a strip extending from the slide lid, through between the inner case and the outer case, and allowed to reciprocate with said slide lid, so that when said slide lid is opened, the strip collides with an inner surface of the outer case, thereby determining an open position.

5. The cigarette box according to claim 3, wherein said stopper includes a U-shaped strap extending from said slide lid, having a U-shape surrounding the inner case, and allowed to reciprocate with said slide lid, so that when said slide lid is opened, the strap collides with the inner surface of the outer case, thereby determining an open position for said slide lid, and that when said slide lid is pulled upward, the strap collides with a bottom of the inner case, thereby preventing said slide lid from coming off said box body.

6. A blank set for forming the cigarette box according to claim 5, comprising:

an inner blank for forming the inner case, an outer blank for forming the outer case, and a lid blank for forming said slide lid, said lid blank including a top panel, a front panel and a rear panel arranged in a line, adjacent to each other, where the adjacent panels are demarcated by a fold line, the top panel, the front panel and the rear panel being designed to form a top wall, the front wall and the rear wall of said slide lid, respectively, inner side flaps joined to one side edges of the front panel and the rear panel across fold lines, respectively, an outer side flap disposed on a same side as the inner side flaps and joined to one side edge of the top panel across a fold line, the outer side flap being designed to form the side wall of said slide lid in corporation with the inner side flaps, extension flaps in a pair disposed on the other side to said inner side flaps and jointed to side edges of the front panel and the rear panel across fold lines, respectively, the extension flaps extending oppositely to each other, along the direction of the arrangement of the panels, and bottom flaps in a pair joined to the distal ends of the extension flaps across fold lines, respectively, the bottom flaps being designed to be joined together to form the strap in cooperation with the extension flaps.

7. A cigarette box for containing an inner pack, the inner pack including a bundle of cigarettes and a wrapper wrapping the bundle, comprising:

a box body enclosing the inner pack and having an access opening for the cigarettes at the top thereof, the access opening facing upward, and a slide lid attached to cover an upper portion of the box body, said slide lid being allowed to reciprocate along a breadth of said box body to open and close the access opening;

said box body includes:

an inner case providing the access opening, and an outer case enclosing the inner case except for an upper portion of the inner case, where said slide lid has a side opening at one side, the side opening allowing the slide lid to reciprocate;

the outer case includes a side wall disposed on the same side as the side opening and an extension extending upward from the side wall, the extension covering a side wall of said upper portion of the inner case, from the outside;

a stopper for preventing the slide lid from coming off said box body, said stopper includes a strip extending from the slide lid, through between the inner case and the outer case, and allowed to reciprocate with said slide lid, so that when said slide lid is opened, the strip collides with the inner surface of the outer case, thereby determining an open position.

8. A cigarette box for containing an inner pack, the inner pack including a bundle of cigarettes and a wrapper wrapping the bundle, comprising:

a box body enclosing the inner pack and having an access opening for the cigarettes at the top thereof, the access opening facing upward, and a slide lid attached to cover an upper portion of the box body, said slide lid being allowed to reciprocate along a breadth of said box body to open and close the access opening;

said box body includes:

an inner case providing the access opening, and an outer case enclosing the inner case except for an upper portion of the inner case, where said slide lid has a side opening at one side, the side opening allowing the slide lid to reciprocate;

the outer case includes a side wall disposed on the same side as the side opening and an extension extending upward from the side wall, the extension covering a side wall of said upper portion of the inner case, from the outside;

a stopper for preventing the slide lid from coming off said box body, wherein said stopper includes a U-shaped strap extending from said slide lid, having a U-shape surrounding the inner case, and allowed to reciprocate with said slide lid, so that when said slide lid is opened, the strap collides with the inner surface of the outer case, thereby determining an open position for said slide lid, and that when said slide lid is pulled upward, the strap collides with the bottom of the inner case, thereby preventing said slide lid from coming off said box body.

9. A blank set for forming the cigarette box according to claim 8, comprising:

an inner blank for forming the inner case, an outer blank for forming the outer case, and a lid blank for forming said slide lid, said lid blank including a top panel, a front panel and a rear panel arranged in a line, adjacent to each other, where the adjacent panels are demarcated by a fold line, the top panel, the front panel and the rear panel being designed to form a top wall, a front wall and a rear wall of said slide lid, respectively, inner side flaps joined to one side edges of the front panel and the rear panel across fold lines, respectively, an outer side flap disposed on the same side as the inner side flaps and joined to one side edge of the top panel across a fold line, the outer side flap being designed to form a side wall of said slide lid in corporation with the inner side flaps, extension flaps in a pair disposed on the other side to said inner side flaps and jointed to side edges of the front panel and the rear panel across fold lines, respectively, the extension flaps extending oppositely to each other, along the direction of the arrangement of the panels, and bottom flaps in a pair joined to the distal ends of the extension flaps across fold lines, respectively, the bottom flaps being designed to be joined together to form the strap in cooperation with the extension flaps.

10. A cigarette box for containing an inner pack, the inner pack including a bundle of cigarettes and a wrapper wrapping the bundle, comprising:

a box body enclosing the inner pack and having an access opening for the cigarettes at the top thereof, the access opening facing upward, and a slide lid attached to cover an upper portion of said box body, said slide lid including a front wall, a rear wall and a side wall which surround the upper portion of said box body, and a side opening so that said slide lid is allowed to reciprocate along a breadth of said box body to open and close the access opening, wherein when the slide lid is opened, the slide lid projects a predetermined distance in a width direction of the box body to project outwardly therefrom for imparting a distinctive appearance to the opened cigarette box;

said box body includes:

an inner case providing the access opening, and an outer case enclosing the inner case except for an upper portion of the inner case, said slide lid covers the upper portion of the inner case, and said outer case has a top opening through which the upper portion of the inner case projects, and said lid is seated on front and rear edges of said top opening to be slid on the front and rear edges.

* * * * *